US008653762B2

(12) United States Patent
Eriksson et al.

(10) Patent No.: US 8,653,762 B2
(45) Date of Patent: Feb. 18, 2014

(54) PARTICLE ACCELERATORS HAVING ELECTROMECHANICAL MOTORS AND METHODS OF OPERATING AND MANUFACTURING THE SAME

(75) Inventors: Tomas Eriksson, Uppsala (SE); Bert Holmgren, Uppsala (SE)

(73) Assignee: General Electric Company, Schenectady, NY (US)

( * ) Notice: Subject to any disclaimer, the term of this patent is extended or adjusted under 35 U.S.C. 154(b) by 378 days.

(21) Appl. No.: 12/977,208

(22) Filed: Dec. 23, 2010

(65) Prior Publication Data

US 2012/0161671 A1 Jun. 28, 2012

(51) Int. Cl.
*H05H 7/00* (2006.01)
*H05H 15/00* (2006.01)

(52) U.S. Cl.
USPC ..... 315/501; 315/500; 29/592.1

(58) Field of Classification Search
USPC ..... 315/500, 501; 29/592.1
See application file for complete search history.

(56) References Cited

U.S. PATENT DOCUMENTS

| | | | | |
|---|---|---|---|---|
| 6,057,655 | A | 5/2000 | Jongen | |
| 6,323,647 | B1 * | 11/2001 | Anderson et al. | 324/313 |
| 6,445,146 | B1 | 9/2002 | Bergström et al. | |
| 7,122,966 | B2 | 10/2006 | Norling et al. | |
| 7,355,325 | B2 | 4/2008 | Johansson et al. | |
| 2008/0067413 | A1 | 3/2008 | Nutt | |
| 2009/0230956 | A1 * | 9/2009 | Finnigan | 324/307 |
| 2010/0019622 | A1 | 1/2010 | Johansson | |
| 2010/0148629 | A1 | 6/2010 | Bexell et al. | |

OTHER PUBLICATIONS

Bonofiglio, et al., Stripper Foil Mechanism for the K1200 Superconducting Cyclotron, 2001, American Institute of Physics, CP600, Cyclotrons and Their Applications, pp. 117-119.*
York, et al., The NSCL Coupled Cyclotron Project—Overview and Status, Jun. 1998, 15th International Conference on Cyclotrons and Their Applications in CAEN, pp. 687-691.*
Milton, Bruce F., "Commerical Compact Cyclotrons in the 90's", TRUIMF, pp. 1-8.
Hichwa, et al., "Design of Target Systems For Production of Pet Nuclides" Nuclear Instruments and Methods in Physics Research, 1989, pp. 1110-1113.
PiezoLEGS Linear-NM Parts List.
Strijckmans, K., "The isochronous cyclotron: principles and recent developments", Computerized Medical Imaging and Graphics, 25, 2001, pp. 59-78.
Kjellström, et al., "MC32 Multiparticle Negative Ion Cyclotron", Nuclear Medicine Division, Scanditronix AB.

* cited by examiner

*Primary Examiner* — Jerome Jackson, Jr.
*Assistant Examiner* — David Lotter

(57) ABSTRACT

A particle accelerator including an electrical field system and a magnetic field system that are configured to direct charged particles along a desired path within an acceleration chamber. The particle accelerator also includes a mechanical device that is located within the acceleration chamber. The mechanical device is configured to be selectively moved to different positions within the acceleration chamber. The particle accelerator also includes an electromechanical (EM) motor having a connector component and piezoelectric elements that are operatively coupled to the connector component. The connector component is operatively attached to the mechanical device. The EM motor drives the connector component when the piezoelectric elements are activated thereby moving the mechanical device.

17 Claims, 7 Drawing Sheets

PARTICLE ACCELERATORS HAVING ELECTROMECHANICAL MOTORS AND METHODS OF OPERATING AND MANUFACTURING THE SAME

BACKGROUND OF THE INVENTION

Embodiments of the invention described herein relate generally to particle accelerators, and more particularly to particle accelerators having moveable mechanical devices located within acceleration chambers.

Particle accelerators, such as cyclotrons, may have various industrial, medical, and research applications. For example, particle accelerators may be used to produce radioisotopes (also called radionuclides), which have uses in medical therapy, imaging, and research, as well as other applications that are not medically related. Systems that produce radioisotopes typically include a cyclotron that has a magnet yoke surrounding an acceleration chamber. The cyclotron may include opposing pole tops that are spaced apart from each other. Electrical and magnetic fields may be generated within the acceleration chamber to accelerate and guide charged particles along a spiral-like orbit between the poles. To produce the radioisotopes, the cyclotron forms a particle beam of the charged particles and directs the particle beam out of the acceleration chamber and toward a target system having a target material. In some cases the target system may be situated inside the acceleration chamber. The particle beam is incident upon the target material thereby generating radioisotopes.

It may be desirable to use various mechanical devices within the acceleration chamber during operation of a particle accelerator. For example, it may be desirable to move a foil holder, which holds a foil that strips electrons from charged particles. It may also be desirable to move a diagnostic probe to test the particle beam along different portions of the desired path. However, these and other mechanical devices must be capable of operating within the environment of the acceleration chamber. During operation of the particle accelerator, the acceleration chamber may be evacuated and a large magnetic field may exist therein. In some cases, magnetic components in the mechanical devices may disturb the magnetic field responsible for directing the charged particles. Furthermore, a large amount of radiation may exist along the interior surfaces that define the acceleration chamber. In addition to the above concerns regarding the environment, mechanical devices within the acceleration chamber may require a large amount of space and be difficult to operate or may lack a high level of precision. In addition, mechanical devices within the acceleration chamber can be mechanically linked to electromagnetic actuators/motors outside of the vacuum chamber. These motors cannot operate effectively in a high magnetic field of the acceleration chamber and can also interfere with the well-defined magnetic field therein. As such, the electromagnetic motors may be interconnected to the mechanical devices inside the acceleration chamber with mechanical components that extend through a vacuum feed. However, these mechanical components and the vacuum feed increase the complexity of the particle accelerator.

Accordingly, there is a need for particle accelerators having mechanical devices in the acceleration chamber that are smaller, less costly, and/or easier to operate than known mechanical devices. There is also a need for particle accelerators and methods that reduce radiation exposure to individuals who operate or maintain the particle accelerators. There is also a general need for alternative devices that facilitate operating and/or maintaining particle accelerators and/or that are not sensitive to radiation exposure.

BRIEF DESCRIPTION OF THE INVENTION

In accordance with one embodiment, a particle accelerator is provided that includes an electrical field system and a magnetic field system that are configured to direct charged particles along a desired path within an acceleration chamber. The particle accelerator also includes a mechanical device that is located within the acceleration chamber. The mechanical device is configured to be selectively moved to different positions within the acceleration chamber. The particle accelerator also includes an electromechanical (EM) motor having a connector component and piezoelectric elements that are operatively coupled to the connector component. The connector component is operatively attached to the mechanical device. The EM motor drives the connector component when the piezoelectric elements are activated.

In accordance with another embodiment, a method of operating a particle accelerator having an acceleration chamber is provided. The method includes providing a particle beam of charged particles in the acceleration chamber. The particle beam is directed along a desired path by the particle accelerator. The method also includes selectively moving a mechanical device within the acceleration chamber. The mechanical device is moved by an electromechanical (EM) motor that includes a connector component and piezoelectric elements operatively coupled to the connector component. The connector component is operatively attached to the mechanical device. The EM motor drives the connector component when the piezoelectric elements are activated.

In yet another embodiment, a method of manufacturing a particle accelerator having an acceleration chamber is provided. The particle accelerator includes an electrical field system and a magnetic field system that are configured to direct charged particles along a desired path within the acceleration chamber. The method includes positioning a mechanical device within the acceleration chamber. The mechanical device is configured to be selectively moved to different positions within the acceleration chamber. The method also includes operatively coupling an electromechanical (EM) motor to the mechanical device. The EM motor has a connector component and piezoelectric elements that are operatively coupled to the connector component. The connector component is operatively attached to the mechanical device, wherein the EM motor is configured to drive the connector component when the piezoelectric elements are activated thereby moving the mechanical device.

DETAILED DESCRIPTION OF THE INVENTION

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
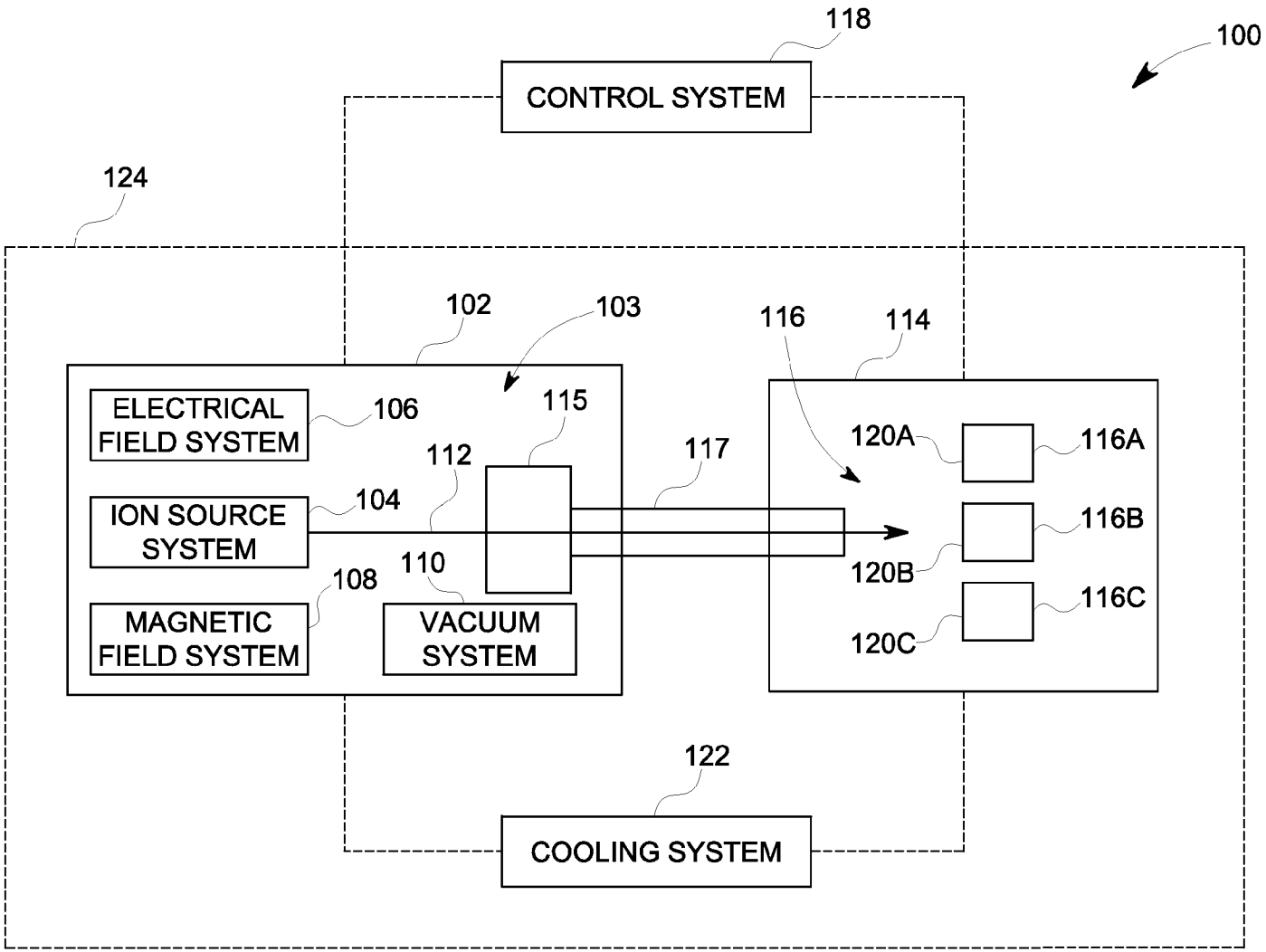
FIG. 1 is a block diagram of a particle accelerator in accordance with one embodiment.

FIG. 1 is a block diagram of an isotope production system 100 formed in accordance with one embodiment. The system 100 includes a particle accelerator 102 that has several sub-systems including an ion source system 104, an electrical field system 106, a magnetic field system 108, and a vacuum system 110. The particle accelerator 102 may be, for example, a cyclotron or, more specifically, an isochronous cyclotron. The particle accelerator 102 may include an acceleration chamber 103 The acceleration chamber 103 may be defined by a housing or other portions of the particle accelerator and has an evacuated state or condition. The particle accelerator shown in FIG. 1 has at least portions of the sub-systems 104, 106, 108, and 110 located in the acceleration chamber 103. During use of the particle accelerator 102, charged particles are placed within or injected into the acceleration chamber 103 of the particle accelerator 102 through the ion source system 104. The magnetic field system 108 and the electrical field system 106 generate respective fields that cooperate in producing a particle beam 112 of the charged particles. The charged particles are accelerated and guided within the acceleration chamber 103 along a predetermined or desired path. During operation of the particle accelerator 102, the acceleration chamber 103 may be in a vacuum (or evacuated) state and experience a large magnetic flux. For example, an average magnetic field strength between pole tops in the acceleration chamber 103 may be at least 1 Tesla. Furthermore, before the particle beam 112 is created, a pressure of the acceleration chamber 103 may be approximately $1\times10^{-7}$ millibars. After the particle beam 112 is generated, the pressure of the acceleration chamber 103 may be approximately $2\times10^{-5}$ millibar.

Also shown in FIG. 1, the system 100 has an extraction system 115 and a target system 114 that includes a target material 116. In the illustrated embodiment, the target system 114 is positioned adjacent to the particle accelerator 102. To generate isotopes, the particle beam 112 is directed by the particle accelerator 102 through the extraction system 115 along a beam transport path or beam passage 117 and into the target system 114 so that the particle beam 112 is incident upon the target material 116 located at a corresponding target location 120. When the target material 116 is irradiated with the particle beam 112, radiation from neutrons and gamma rays may be generated. In alternative embodiments, the system 100 may have a target system located within or directly attached to the accelerator chamber 103.

The system 100 may have multiple target locations 120A-C where separate target materials 116A-C are located. A shifting device or system (not shown) may be used to shift the target locations 120A-C with respect to the particle beam 112 so that the particle beam 112 is incident upon a different target material 116. A vacuum may be maintained during the shifting process as well. Alternatively, the particle accelerator 102 and the extraction system 115 may not direct the particle beam 112 along only one path, but may direct the particle beam 112 along a unique path for each different target location 120A-C. Furthermore, the beam passage 117 may be substantially linear from the particle accelerator 102 to the target location 120 or, alternatively, the beam passage 117 may curve or turn at one or more points therealong. For example, magnets positioned alongside the beam passage 117 may be configured to redirect the particle beam 112 along a different path.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make $^{18}F^-$ isotopes in liquid form, $^{11}C$ isotopes as $CO_2$, and $^{13}N$ isotopes as $NH_3$. The target material 116 used to make these isotopes may be enriched $^{18}O$ water, natural $^{14}N_2$ gas, $^{16}O$-water. The system 100 may also generate protons or deuterons in order to produce $^{15}O$ gases (oxygen, carbon dioxide, and carbon monoxide) and $^{15}O$ labeled water.

In particular embodiments, the system 100 uses $^{1}H^-$ technology and brings the charged particles to a low energy (e.g., about 9.6 MeV) with a beam current of approximately 10-30 μA. In such embodiments, the negative hydrogen ions are accelerated and guided through the particle accelerator 102 and into the extraction system 115. The negative hydrogen ions may then hit a stripping foil (not shown in FIG. 1) of the extraction system 115 thereby removing the pair of electrons and making the particle a positive ion, $^{1}H^+$. However, embodiments described herein may be applicable to other types of particle accelerators and cyclotrons. For example, in alternative embodiments, the charged particles may be positive ions, such as $^{1}H^+$, $^{2}H^+$, and $^{3}He^+$. In such alternative embodiments, the extraction system 115 may include an electrostatic deflector that creates an electric field that guides the particle beam toward the target material 116. Furthermore, in other embodiments, the beam current may be, for example, up to approximately 200 μA. The beam current could also be up to 2000 μA or more.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the particle accelerator 102 and the target system 114. Although not shown in FIG. 1, the system 100 may also include one or more radiation and/or magnetic shields for the particle accelerator 102 and the target system 114.

The system 100 may also be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less. However, embodiments describe herein may also have an energy above 18 MeV. For example, embodiments may have an energy above 100 MeV, 500 MeV or more.

As will be discussed in greater detail below, the system 100 may include various mechanical devices that are configured to operate within the particle accelerator 102. In some embodiments, the mechanical devices may effectively operate within the acceleration chamber 103, such as when the particle beam 112 is being produced. As such, the mechanical devices may be configured to effectively operate in an environment that is in a vacuum, is experiencing large magnetic flux fields, high frequency and high voltage fields, and/or has a large amount of unwanted radiation. In other embodiments, the mechanical devices described herein may be configured to operate in the target system 114.

Figure 2:
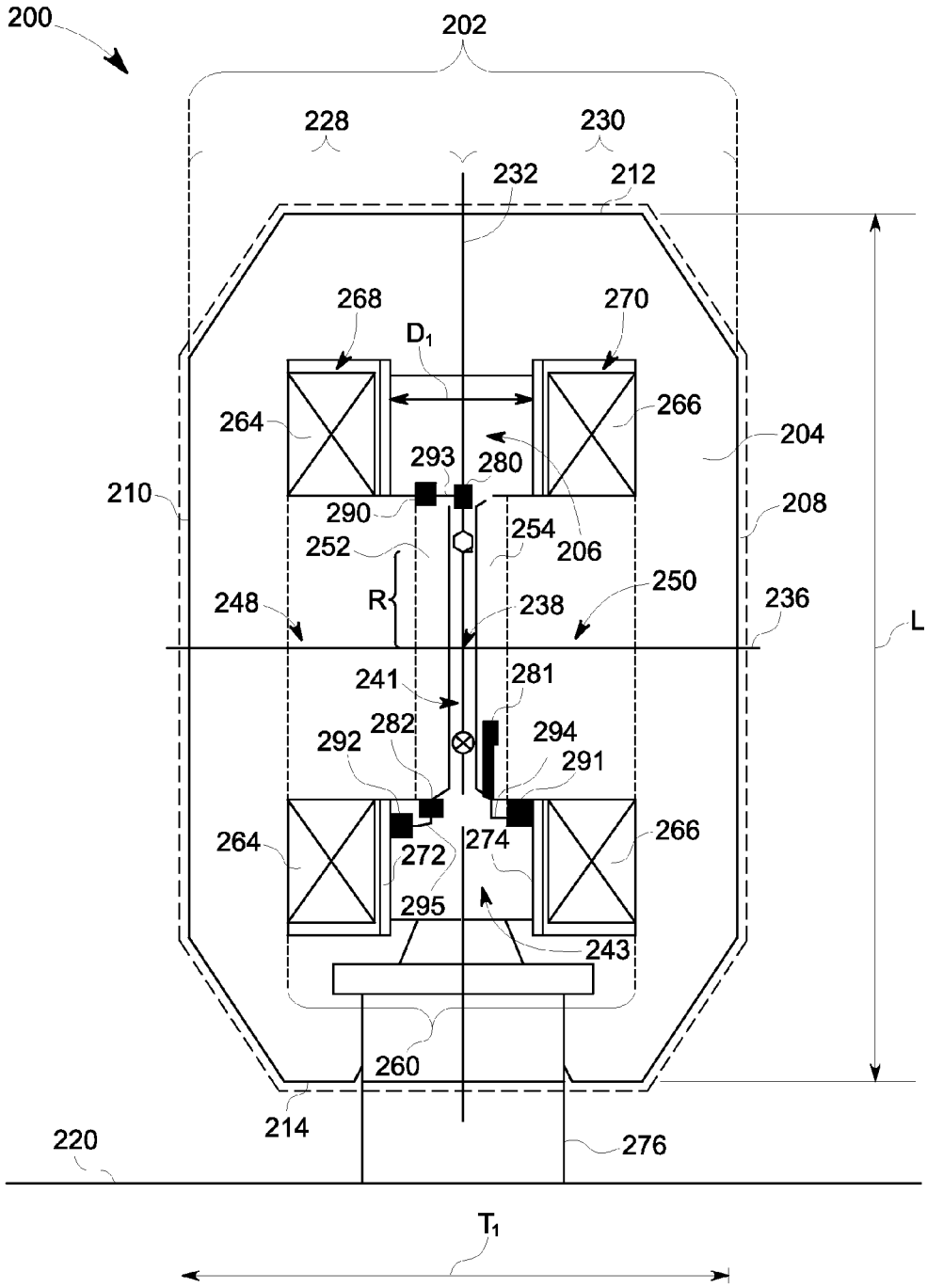
FIG. 2 is a schematic side view of a particle accelerator in accordance with one embodiment.

FIG. 2 is a side view of a cyclotron 200 formed in accordance with one embodiment. Although the following description is with respect to the cyclotron 200, it is understood that embodiments may include other particle accelerators and methods involving the same. As shown in FIG. 2, the cyclotron 200 includes a magnet yoke 202 having a yoke body 204 that surrounds an acceleration chamber 206. In alternative embodiments, the acceleration chamber may be surrounded or defined by components other than a magnet yoke, such as a housing or shield. The yoke body 204 has opposite side faces 208 and 210 with a thickness $T_1$ extending therebetween and also has top and bottom ends 212 and 214 with a length L extending therebetween. In the exemplary embodiment, the yoke body 204 has a substantially circular cross-section and, as such, the length L may represent a diameter of the yoke body 204. The yoke body 204 may be manufactured from iron and be sized and shaped to produce a desired magnetic field when the cyclotron 200 is in operation.

The yoke body 204 may have opposing yoke sections 228 and 230 that define the acceleration chamber 206 therebetween. The yoke sections 228 and 230 are configured to be positioned adjacent to one another along a mid-plane 232 of the magnet yoke 202. As shown, the cyclotron 200 may be oriented vertically (with respect to gravity) such that the mid-plane 232 extends perpendicular to a horizontal platform 220 supporting the weight of the cyclotron 200. The cyclotron 200 has a central axis 236 that extends horizontally between and through the yoke sections 228 and 230 (and corresponding side faces 210 and 208, respectively). The central axis 236 extends perpendicular to the mid-plane 232 through a center of the yoke body 204. The acceleration chamber 206 has a central region 238 located at an intersection of the mid-plane 232 and the central axis 236. In some embodiments, the central region 238 is at a geometric center of the acceleration chamber 206.

The yoke sections 228 and 230 include poles 248 and 250, respectively, that oppose each other across the mid-plane 232 within the acceleration chamber 206. The poles 248 and 250 may be separated from each other by a pole gap G. The pole 248 includes a pole top 252 and the pole 250 includes a pole top 254 that opposes the pole top 252. The poles 248 and 250 and the pole gap G therebetween are sized and shaped to produce a desired magnetic field when the cyclotron 200 is in operation. For example, in some embodiments, the pole gap G may be 3 cm.

The cyclotron 200 also includes a magnet assembly 260 located within or proximate to the acceleration chamber 206. The magnet assembly 260 is configured to facilitate producing the magnetic field with the poles 248 and 250 to direct charged particles along a desired beam path. The magnet assembly 260 includes an opposing pair of magnet coils 264 and 266 that are spaced apart from each other across the mid-plane 232 at a distance $D_1$. The magnet coils may be substantially circular and extend about the central axis 236. The yoke sections 228 and 230 may form magnet coil cavities 268 and 270, respectively, that are sized and shaped to receive the corresponding magnet coils 264 and 266, respectively. Also shown in FIG. 2, the cyclotron 200 may include chamber walls 272 and 274 that separate the magnet coils 264 and 266 from the acceleration chamber 206 and facilitate holding the magnet coils 264 and 266 in position.

The acceleration chamber 206 is configured to allow charged particles, such as $^1H^-$ ions, to be accelerated therein along a predetermined curved path that wraps in a spiral manner about the central axis 236 and remains substantially along the mid-plane 232. The charged particles are initially positioned proximate to the central region 238. When the cyclotron 200 is activated, the path of the charged particles may orbit around the central axis 236. In the illustrated embodiment, the cyclotron 200 is an isochronous cyclotron and, as such, the orbit of the charged particles has portions that curve about the central axis 236 and portions that are more linear. However, embodiments described herein are not limited to isochronous cyclotrons, but also includes other types of cyclotrons and particle accelerators. As shown in FIG. 2, when the charged particles orbit around the central axis 236, the charged particles may project out of the page of the acceleration chamber 206 and extend into the page of the acceleration chamber 206. As the charged particles orbit around the central axis 236, a radius R that extends between the orbit of the charged particles and the central region 238 increases. When the charged particles reach a predetermined location along the orbit, the charged particles are directed into or through an extraction system (not shown) and out of the cyclotron 200. For example, the charged particles may be stripped of their electrons by a foil as discussed below.

The acceleration chamber 206 may be in an evacuated state before and during the forming of the particle beam 112. For example, before the particle beam is created, a pressure of the acceleration chamber 206 may be approximately $1\times10^{-7}$ millibars. When the particle beam is activated and $H_2$ gas is flowing through an ion source (not shown) located at the central region 238, the pressure of the acceleration chamber 206 may be approximately $2\times10^{-5}$ millibar. As such, the cyclotron 200 may include a vacuum pump 276 that may be proximate to the mid-plane 232. The vacuum pump 276 may include a portion that projects radially outward from the end 214 of the yoke body 204.

In some embodiments, the yoke sections 228 and 230 may be moveable toward and away from each other so that the acceleration chamber 206 may be accessed (e.g., for repair or maintenance). For example, the yoke sections 228 and 230 may be joined by a hinge (not shown) that extends alongside the yoke sections 228 and 230. Either or both of the yoke sections 228 and 230 may be opened by pivoting the corresponding yoke section(s) about an axis of the hinge. As another example, the yoke sections 228 and 230 may be separated from each other by laterally moving one of the yoke sections linearly away from the other. However, in alternative embodiments, the yoke sections 228 and 230 may be integrally formed or remain sealed together when the acceleration chamber 206 is accessed (e.g., through a hole or opening of the magnet yoke 202 that leads into the acceleration chamber 206). In alternative embodiments, the yoke body 204 may have sections that are not evenly divided and/or may include more than two sections.

The acceleration chamber 206 may have a shape that extends along and is substantially symmetrical about the mid-plane 232. For instance, the acceleration chamber 206 may be substantially disc-shaped and include an inner spatial region 241 defined between the pole tops 252 and 254 and an outer spatial region 243 defined between the chamber walls 272 and 274. The orbit of the particles during operation of the cyclotron 200 may be within the spatial region 241. The acceleration chamber 206 may also include passages that lead radially outward away from the spatial region 243, such as a passage that extends through the yoke body 204 to a target system.

Furthermore, the poles 248 and 250 (or, more specifically, the pole tops 252 and 254) may be separated by the spatial region 241 therebetween where the charged particles are directed along the desired path. The magnet coils 264 and 266 may also be separated by the spatial region 243. In particular, the chamber walls 272 and 274 may have the spatial region 243 therebetween. Furthermore, a periphery of the spatial region 243 may be defined by a wall surface 255 that also defines a periphery of the acceleration chamber 206. The wall surface 255 may extend circumferentially about the central axis 236. As shown, the spatial region 241 extends a distance equal to a pole gap G along the central axis 236, and the spatial region 243 extends the distance $D_1$ along the central axis 236.

As shown in FIG. 2, the spatial region 243 surrounds the spatial region 241 about the central axis 236. The spatial regions 241 and 243 may collectively form the acceleration chamber 206. Accordingly, in the illustrated embodiment, the cyclotron 200 does not include a separate tank or wall that only surrounds the spatial region 241 thereby defining the spatial region 241 as the acceleration chamber of the cyclotron. For example, the vacuum pump 276 may be fluidly coupled to the spatial region 241 through the spatial region 243. Gas entering the spatial region 241 may be evacuated from the spatial region 241 through the spatial region 243. In the illustrated embodiment, the vacuum pump 276 is fluidly coupled to and located adjacent to the spatial region 243.

Also shown in FIG. 2, the cyclotron 200 may include one or more mechanical devices 280-282 that are operatively attached to electromechanical (EM) motors 290-292. In some embodiments, the mechanical devices 280-282 are configured to be selectively moved to affect the operation of the cyclotron 200 or, more particularly, affect the particle beam. For example, the mechanical devices 280 and 281 may be selectively moved so that the charged particles are incident upon the mechanical device. The mechanical device 282 may be selectively moved to affect the desired path of the particle beam. In addition, the mechanical devices 280 and 281 may extend into the spatial region 241 of the acceleration chamber 206 between the pole tops 252 and 254. The mechanical device 282 may be located in the spatial region 243 of the acceleration chamber 206.

The EM motors 290-292 are operatively attached to the respective mechanical devices 280-282. As used herein, when two elements or assemblies "operatively attached," "operatively coupled," "operatively connected," and the like include the two elements or assemblies being connected together in a manner that allows the two elements or assemblies to perform a desired function. For example, the EM motors 290-292 are attached to the respective mechanical devices 280-282 in such a manner that allows each of the EM motors to selectively move the respective mechanical device. When operatively coupled (or the like) the EM motor and corresponding mechanical device may be directly connected to each other without any intervening parts or components or may be indirectly connected to one another. In either case, movement by the EM motor causes the mechanical device to be moved.

In particular embodiments, the EM motors 290-292 are mounted to one of the pole tops 252 or 254 or are located adjacent to one of the pole tops 252 or 254. The EM motor 292 is located immediately adjacent to the pole top 252 as shown in FIG. 2. For example, the EM motors 290 and 291 are mounted to the pole tops 252 and 254, respectively. The EM motor 292 may be mounted to the chamber wall 272. However, in other embodiments, the EM motors are not mounted to or located adjacent to the pole tops 252 or 254.

The EM motors 290-292 may include a connector component 293-295, respectively, that is operatively attached to the respective mechanical device 280-282. The connector component may be any physical part such as a rod, shaft, link, spring, housing of the EM motor, and the like. The EM motors 290-292 may also include piezoelectric elements (not shown) that are operatively coupled to the corresponding connector component. The piezoelectric elements may be activated to move the connector component thereby moving the corresponding mechanical device. Activation may be provided by applying a voltage or electric field to the piezoelectric elements or by causing strain to the piezoelectric elements. By way of example, the resulting movement of the connector component may be in a linear direction or in a rotational direction. In particular embodiments, the EM motors 290-292 are piezoelectric motors or ultrasonic motors.

Figure 3:
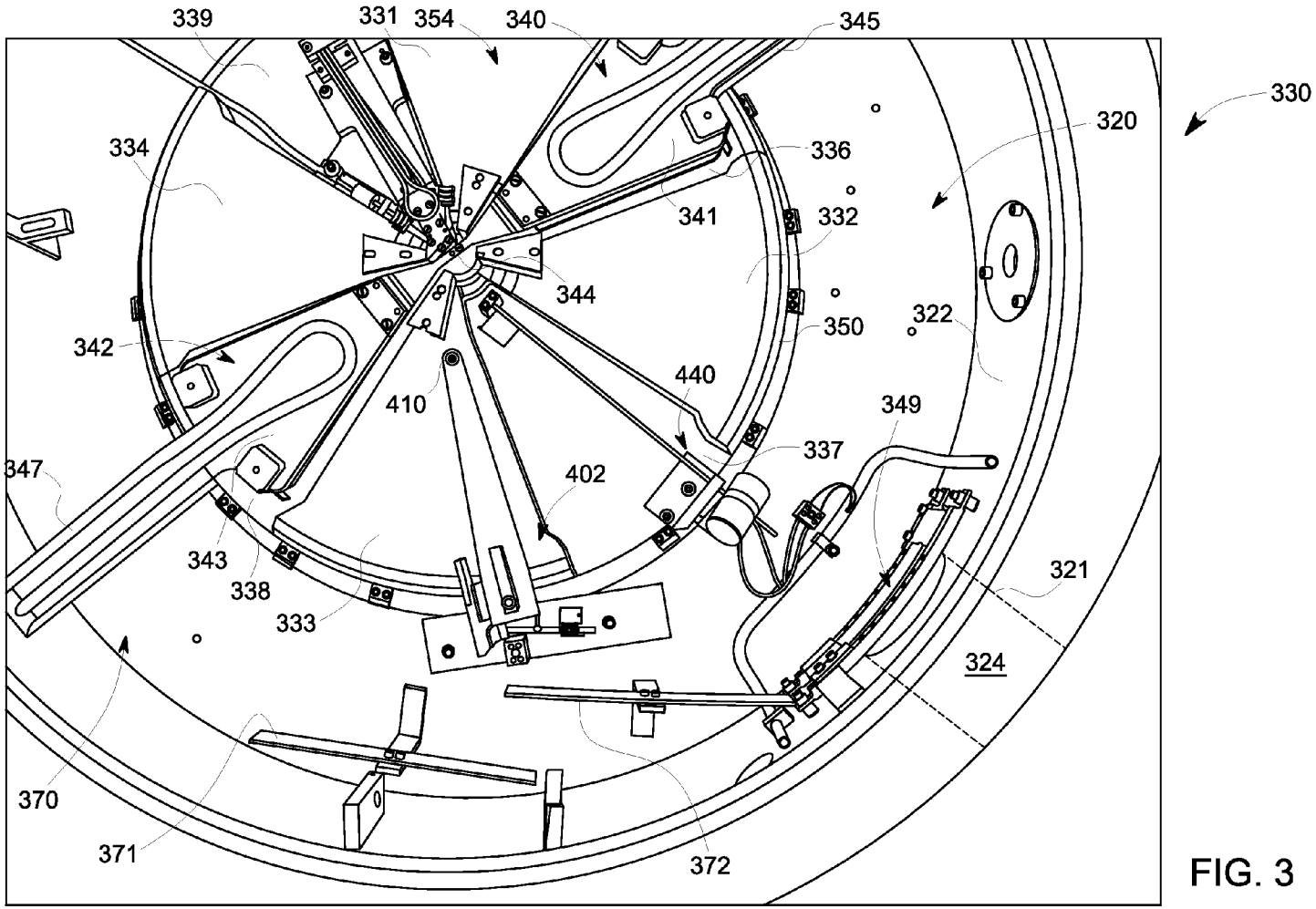
FIG. 3 is a perspective view of a portion of a yoke and pole section that may be used with a particle accelerator in accordance with one embodiment.

FIG. 3 is a partial perspective view of a yoke section 330 formed in accordance with one embodiment. The yoke section 330 may oppose another yoke section (not shown). When the opposing yoke section and the yoke section 330 are sealed together, an acceleration chamber may be formed therebetween. When sealed, the two yoke sections may constitute the magnet yoke of a cyclotron, such as the magnet yoke 202 of the cyclotron 200 described above. The yoke section 330 may have similar components and features as described with respect to the yoke sections 228 and 230 (FIG. 2). As shown, the yoke section 330 includes a ring portion 321 that defines an open-sided cavity 320 having a magnet pole 350 located therein. The open-sided cavity 320 may include portions of inner and outer spatial regions (not shown) of the acceleration chamber, such as the inner and outer spatial regions 241 and 243 discussed above. The ring portion 321 may include a mating surface 324 that is configured to engage a mating surface of the opposing yoke section during operation of the cyclotron. The yoke section 330 includes a yoke or beam passage 349. As indicated by dashed lines, the beam passage 349 extends through the ring portion 321 and provides a path for a particle beam of stripped particles to exit the acceleration chamber.

In some embodiments, a pole top 354 of the pole 350 may include hills 331-334 and valleys 336-339. The hills 331-334 and valleys 336-339 may facilitate directing the charged particles by varying the magnetic field experienced by the charged particles. The yoke section 330 may also include radio frequency (RF) electrodes 340 and 342 that extend radially inward toward each other and toward a center 344 of the pole 350 (or acceleration chamber). The RF electrodes 340 and 342 may include hollow D electrodes or "dees" 341 and 343, respectively, that extend from stems 345 and 347, respectively. The dees 341 and 343 are located within the valleys 336 and 338, respectively. The stems 345 and 347 may be coupled to an interior wall surface 322 of the ring portion 321.

Also shown, the yoke section 330 may include interception panels 371 and 372 arranged about the pole 350. The interception panels 371 and 372 are positioned to intercept lost particles within the acceleration chamber. The interception panels 371 and 372 may comprise aluminum. Although only two interception panels 371 and 372 are shown in FIG. 3, embodiments described herein may include additional interception panels. Furthermore, embodiments described herein may include beam scrapers (not shown) that are located proximate to the pole top 354 within the inner spatial region.

The RF electrodes 340 and 342 may form an RF electrode system 370, such as the electrical field system 106 described with reference to FIG. 1, in which the RF electrodes 340 and 342 accelerate the charged particles within the acceleration chamber. The RF electrodes 340 and 342 cooperate with each other and form a resonant system that includes inductive and capacitive elements tuned to a predetermined frequency (e.g., 100 MHz). The RF electrode system 370 may have a high frequency power generator (not shown) that may include a frequency oscillator in communication with one or more amplifiers. The RF electrode system 370 creates an alternating electrical potential between the RF electrodes 340 and 342 thereby accelerating the charged particles.

Also shown in FIG. 3, a plurality of movable mechanical devices may be disposed within the acceleration chamber. For example, a stripping assembly 402 may be mounted to the pole 350 and a diagnostic probe assembly 440 may also be mounted to the pole 350. In addition to the stripping and probe assemblies 402 and 440, embodiments described may include other movable mechanical devices within the acceleration chamber. The movable mechanical devices may be configured to move during operation of the cyclotron and/or when the magnet yoke is sealed. More specifically, the mechanical devices may be configured to repeatedly operate (e.g., move back and forth between different positions) while within a vacuum state and while sustaining a large magnetic flux.

Figure 4:
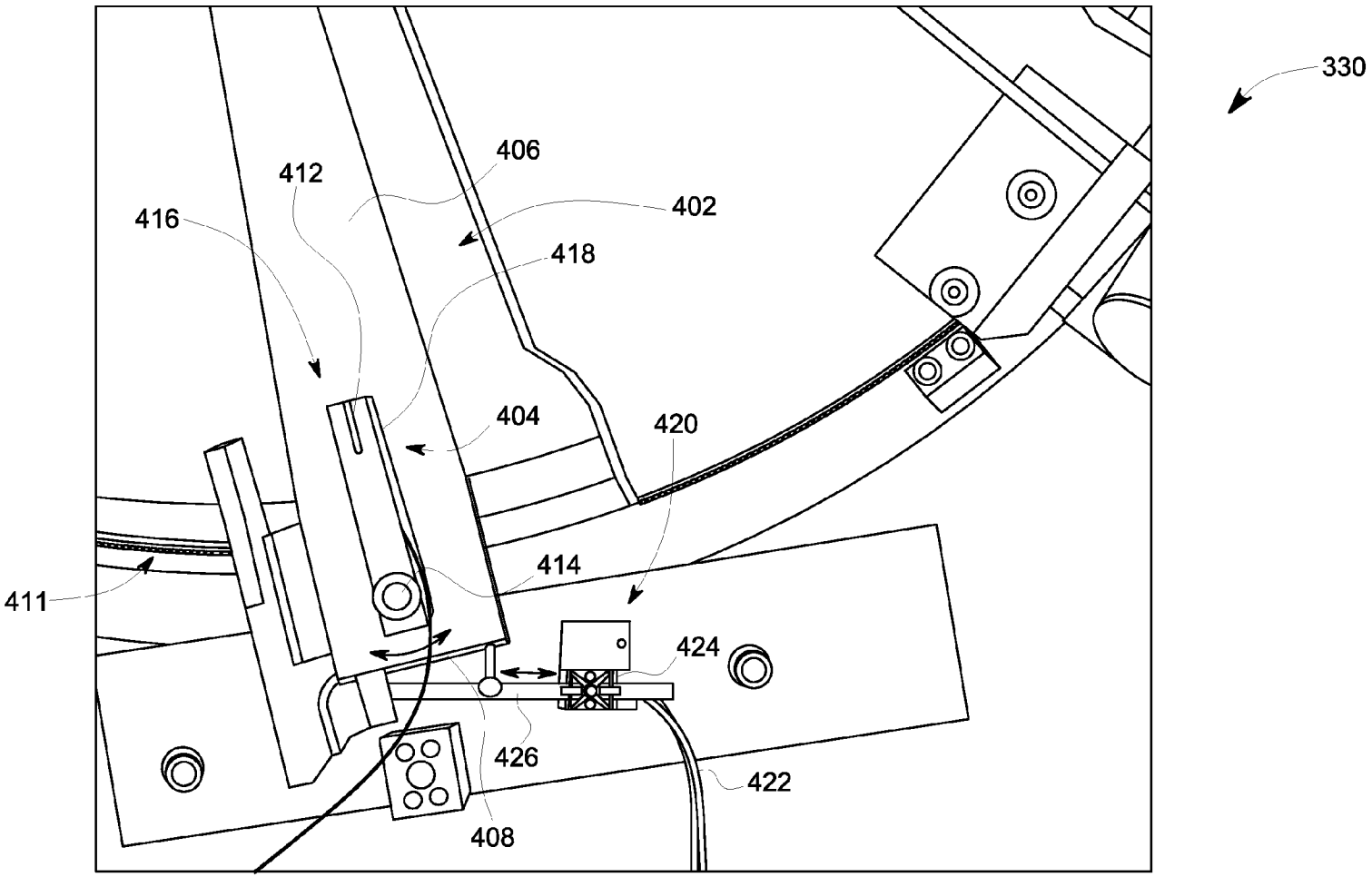
FIG. 4 is an enlarged view of the yoke and pole section in FIG. 3 illustrating a stripping assembly in greater detail.

FIG. 4 is an enlarged view of a portion of the yoke section 330 and illustrates in greater detail the stripping assembly 402. As shown, the stripping assembly 402 includes a rotatable arm 406 and a foil holder 404 that is mounted to the rotatable arm 406. The rotatable arm 406 extends from a proximal end 408 positioned near an outer perimeter 411 of the pole top 354 (FIG. 3) toward the center 344 (FIG. 3). The rotatable arm 406 may extend to a distal end 410 (shown in FIG. 3). In some embodiments, the rotatable arm 406 is configured to pivot about the distal end 410.

The foil holder 404 is configured to be positioned near the outer perimeter 411. In the exemplary embodiment, the foil holder 404 is secured near the proximal end 408 of the rotatable arm 406. The foil holder 404 is configured to hold a stripping foil 412 so that the stripping foil 412 is located within the desired path of the particle beam. As shown, the foil holder 404 may be removably coupled to the rotatable arm 406 using, for example, a fastening device 414. The fastening device 414 may be loosened to reposition the foil holder 404 with respect to the rotatable arm 406 if desired. Furthermore, the foil holder 404 may include a clamp mechanism 416 having opposing fingers that are secured together using, for example, a fastening device 418. To remove or replace the stripping foil 412, the fastening device 418 may be loosened to separate the fingers.

Also shown in FIG. 4, the stripping assembly 402 can be operatively coupled to an electromechanical (EM) motor 420. The EM motor 420 may be communicatively coupled to a control system (not shown) through a cable or wires 422. The EM motor 420 may include an actuator assembly 424 and a connector component 426 that is movably coupled to the actuator assembly 424. The connector component is operatively attached to the stripping assembly 402 (or foil holder 404). For example, the connector component 426 may be attached to the proximal end 408 of the rotatable arm 406. The actuator assembly 424 may include a plurality of piezoelectric elements that are operatively coupled to the connector component 426. The EM motor 420 is configured to drive the connector component 426 when an electric field is applied to the piezoelectric elements thereby moving the rotatable arm 406 and, consequently, the foil holder 404 and the stripping foil 412. The connector component 426 may be selectively moved to different positions by the EM motor 420.

In the illustrated embodiment, the EM motor 420 is a linear piezoelectric motor. The EM motor 420 may comprise non-magnetic material or, more particularly, consist essentially of non-magnetic material. When the EM motor consists essentially of a non-magnetic material, the EM motor has, at most, a negligible effect on the operating magnetic field in the acceleration chamber. For instance, an EM motor consisting essentially of a non-magnetic material could be installed into a pre-existing particle accelerator without reconfiguring the magnetic field system to account for the EM motor. The connector component 426 includes a rod or rail that is moved by the actuator assembly 424 back and forth in a linear direction as indicated by the double-headed arrow. When the connector component 426 is moved in a first direction, the rotatable arm 406 may rotated in a clockwise direction about the distal end 410. When the connector component 426 is moved in an opposite second direction, the rotatable arm 406 may rotate in a counter-clockwise direction about the distal end 410. Accordingly, the EM motor 420 and the stripping assembly 402 may interact with each other to position the stripping foil 412 within the desired path of the particle beam. When the charged particles of the particle beam are incident upon the stripping foil 412, electrons may be removed (or stripped) from the charged particles. The stripped particles may then follow the desired path through the beam passage 349 (FIG. 3).

In alternative embodiments, the stripping assembly 402 may include other parts or components that interact with each other to locate the stripping foil 412. For example, in one alternative embodiment, the stripping assembly 402 may not pivot about the distal end 410 and, instead, may be configured to rotate about an axis that extends through the fastening device 414. Thus, a variety of interconnected mechanical components and parts may be used to selectively move the stripping foil. For example, the stripping assembly 402 and/or the EM motor 420 may include linkages, gears, belts, cam mechanisms, slots, ramps, and joints may be configured to selectively move the stripping foil 412. Likewise, alternative EM motors may be used to move the foil 404. For example, a linear EM motor may directly hold the stripping foil and be configured to move the stripping foil 412 to and from, for example, the center 344. In other embodiments, the EM motor may be configured to rotate about an axis instead of providing a linear movement. The stripping assembly 402 may also comprise or consist essentially of non-magnetic material.

Figure 5:
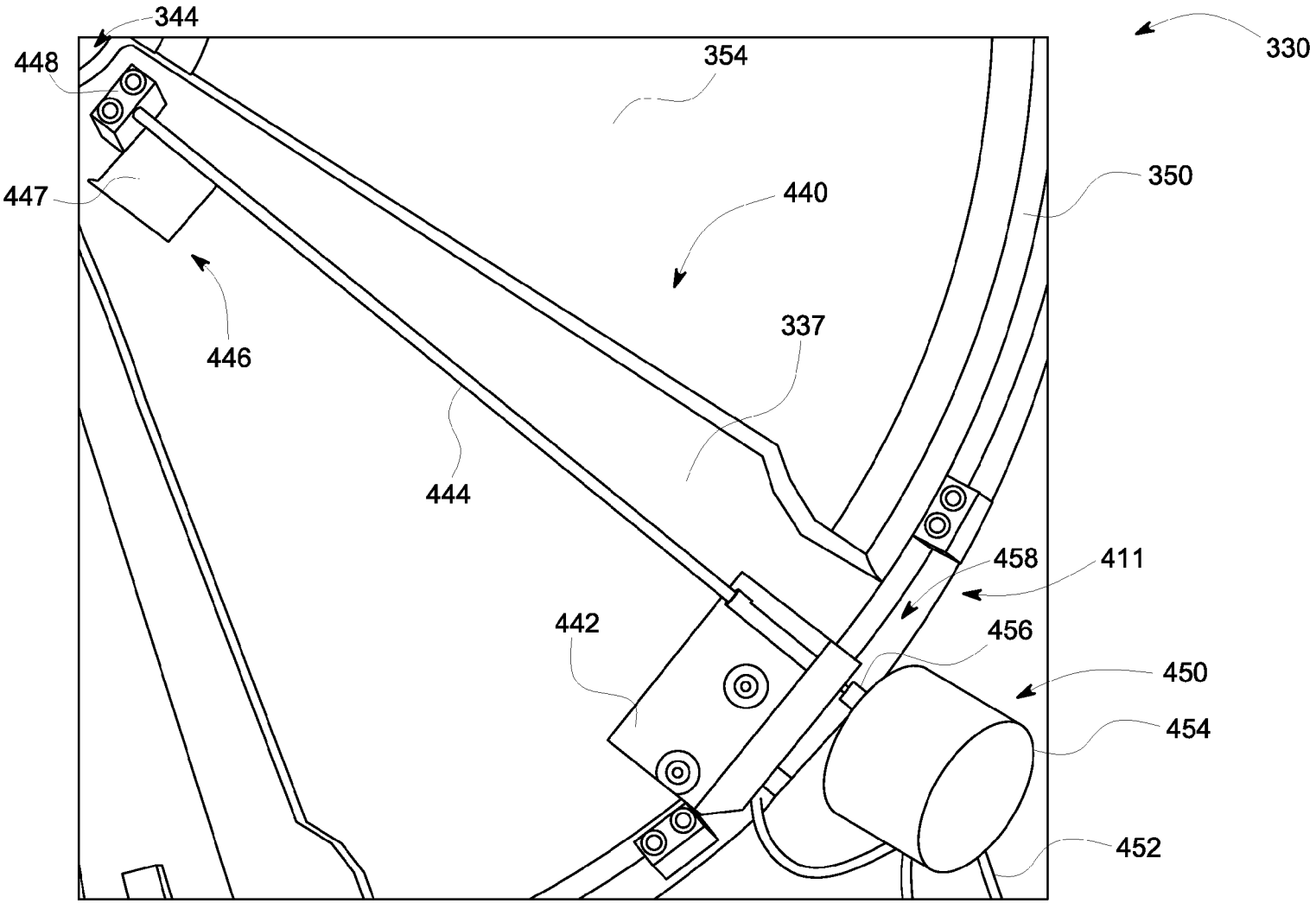
FIG. 5 is an enlarged view of the yoke and pole section in FIG. 3 illustrating a diagnostic probe assembly in greater detail.

FIG. 5 is an enlarged view of a portion of the yoke section 330 and illustrates in greater detail the probe assembly 440. In the illustrated embodiment, the probe assembly 440 is mounted to the pole top 354 and is located within the valley 337. The probe assembly 440 includes a base support 442 that is secured proximate to the outer perimeter 411 and a shaft member 444 that is rotatably coupled to the base support 442. The shaft member 444 extends radially inward toward the center 344 of the pole 350. The probe assembly 440 also includes a beam detector 446 that is attached to a distal end of the shaft member 444. In the illustrated embodiment, the beam detector 446 comprises a tab or flag 447. Optionally, the probe assembly 440 may include a distal support 448 that is rotatably coupled to the distal end of the shaft member 444.

Also shown in FIG. 5, the probe assembly 440 can be operatively coupled to an EM motor 450. The EM motor 450 and the beam detector 446 may be communicatively coupled to a control system (not shown) through a cable or wires 452. The EM motor 450 may include an actuator assembly 454 and a connector component 456 that is coupled to the actuator assembly 454. The connector component 456 is operatively attached to the probe assembly 440. For example, the connector component 456 may be attached to a proximal end 458 of the shaft member 444. Similar to the EM motor 420, the actuator assembly 454 may include a plurality of piezoelectric elements that are operatively coupled to the connector component 456. The EM motor 450 is configured to drive the connector component 456 when an electric field is applied to the piezoelectric elements thereby moving the shaft member 444 and, consequently, the beam detector 446. The connector component 456 may be selectively moved to different positions by the EM motor 450 thereby selectively moving the shaft member 444.

In the illustrated embodiment, the EM motor 450 is a rotary piezoelectric motor. In alternative embodiments, the EM motor 450 may be a linear motor that is operatively coupled to move the tab 447 in the proper manner. In alternative embodiments, the EM motor 450 may comprise an ultrasonic motor. In some embodiments, the EM motor 450 may comprise non-magnetic material or, more particularly, consist essentially of non-magnetic material. As shown, the connector component 456 comprises a rod or shaft that is moved by the actuator assembly 454 back and forth in a rotational direction as indicated by the double-headed arrow. When the connector component 456 is moved in a first direction, the shaft member 444 may move the beam detector 446 into the desired path. When the connector component 426 is moved in an opposite second direction, the shaft member 444 may move the beam detector 446 out of the desired path. Accordingly, the EM motor 450 and the probe assembly 440 may interact with each other to position the beam detector 446 within the desired path so that charged particles are incident thereon.

The probe assembly 440 may be used to test a quality or condition of the particle beam at different points along the desired path. The measurements obtained at one point of the desired path may be compared to measurements taken at other points along the desired path. For example, measurements taken by the beam detector 446 may be used to determine an amount of losses for the particle beam.

Figure 6:
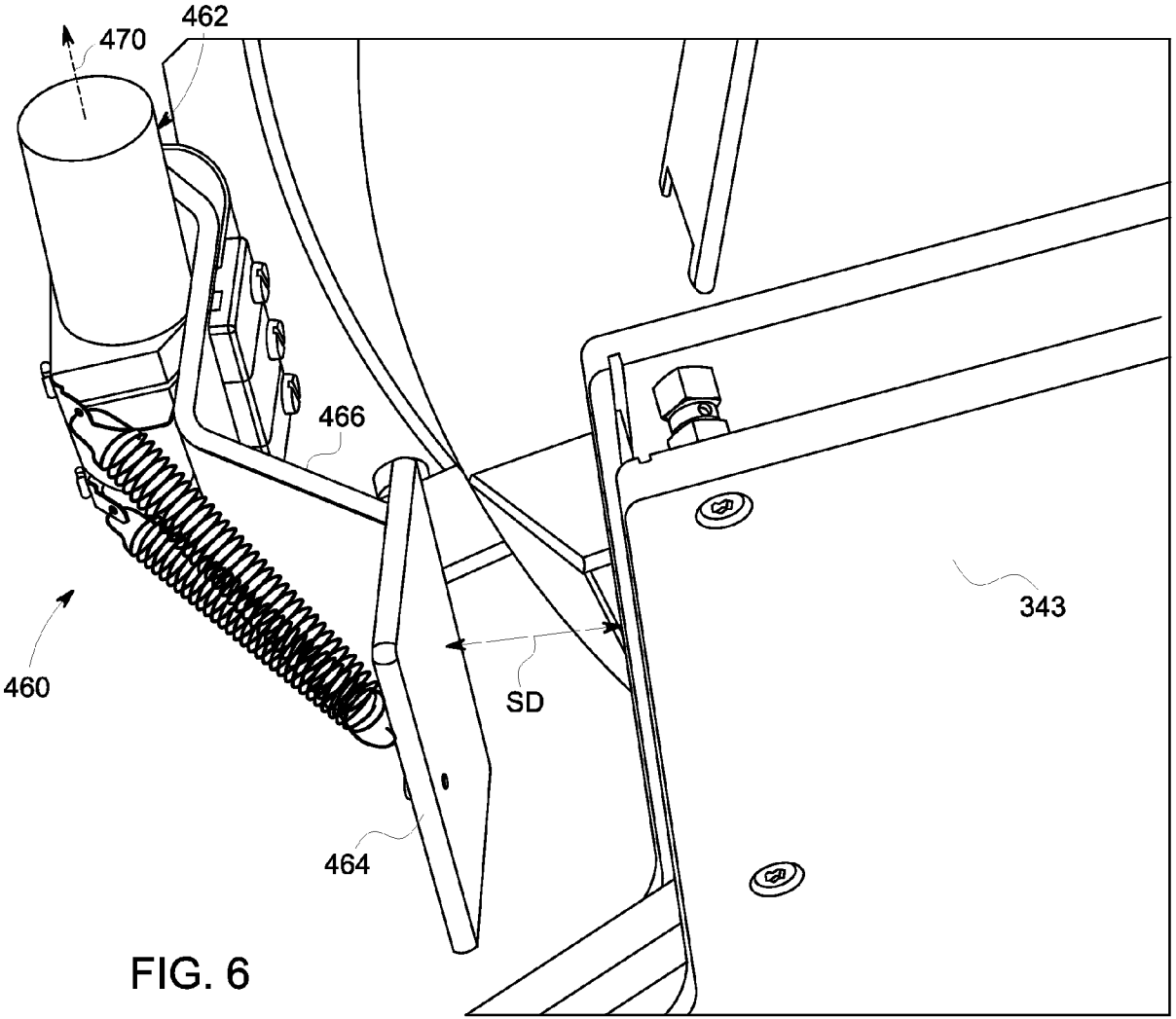
FIG. 6 is an enlarged view of a yoke and pole section illustrating an RF tuning assembly in accordance with one embodiment.

FIG. 6 is a perspective view of the hollow dee (or RF resonator) 343 and an RF device 460 operatively coupled to an EM motor 462. In the illustrated embodiment, the RF device 460 is mounted to the EM motor 462 and is located proximate to an outer periphery of the hollow dee 343. The RF device 460 includes a capacitor plate 464 and a base extension 466 that is operatively coupled to the EM motor 462. The capacitor plate 464 substantially faces and is spaced apart from the hollow dee 343 by a separation distance SD. The EM motor 462 is a rotary type motor configured to rotate the RF device 460 about an axis 470. When the RF device 460 is rotated about the axis 470, the capacitor plate 464 is moved to and from the hollow dee 343 to change the separation distance SD. Accordingly, the EM motor 462 may be configured to selectively move the capacitor plate 464 to and from the hollow dee 343 thereby changing the separation distance SD. By changing the separation distance SD, the resonance frequency of the cyclotron can be tuned to affect the charged particles in the particle beam.

Figure 9:
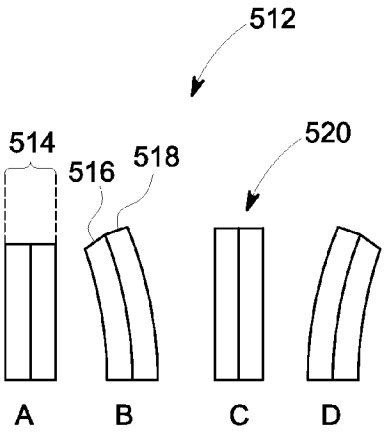
FIG. 9 illustrates movement of one piezoelectric element.
Figure 8:
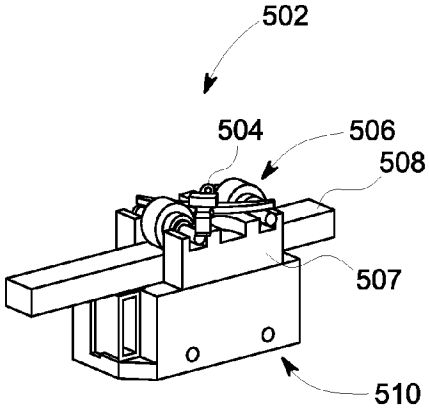
FIG. 8 is a perspective view of the EM motor in FIG. 7.
Figure 7:
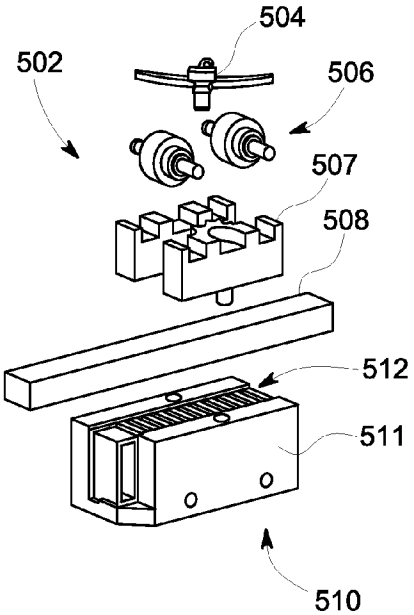
FIG. 7 is an exploded view of an electromechanical (EM) motor that may be used in various embodiments.

FIGS. 7-10 illustrate in greater detail EM motors that may be used with embodiments described herein. However, the EM motors described herein are only exemplary and other EM motors may be used. FIGS. 7-9 illustrate in greater detail a linear type EM motor 502, which may be similar to the EM motor 420 shown in FIG. 4. By way of example, the EM motors 420 and 502 may be Piezo LEGS™ motors manufactured by PiezoMotor®. FIG. 7 is an exploded view of the EM motor 502, and FIG. 8 illustrates the assembled EM motor 502. As shown, the EM motor 502 includes tensions springs 504, rollers 506, a holder 507, a drive rod (or connector component) 508, and an actuator assembly 510. That actuator assembly 510 includes a housing 511 that has a plurality of piezoelectric elements 512 (FIG. 7) therein. The drive rod 508 is configured to be operatively coupled to the actuator assembly 510 or, more specifically, the piezoelectric elements 512. In the illustrated embodiment, the drive rod 508 is pressed against the piezoelectric elements 512 by the rollers 506 and the tension springs 504.

FIG. 9 illustrates exemplary movement of one piezoelectric element 512 through different stages A-D when activated by an applied voltage. When a plurality of the piezoelectric elements 512 are arranged in series, such as in the EM motor 502, the piezoelectric elements 512 may cooperate to move the drive rod 508 in a linear direction. As shown, the piezoelectric element 512 comprises a piezoceramic bimorph 514 having two piezoelectric layers 516 and 518 with one intermediate electrode and two external electrodes (not shown) separated from each other. A distal end 520 of the piezoelectric element 512 is configured to operatively engage the drive rod 508. Accordingly, each layer 516 or 518 may be independently activated by an applied voltage. For example, at stage A, neither of the layers 516 or 518 is activated and the piezoelectric element 512 is in a contracted condition. At stage B, the layer 518 is activated thereby causing the layer 518 to extend. Since the layer 516 is not activated, the piezoelectric element 512 bends or tilts in one direction. At stage C, both layers 516 and 518 are activated so that the piezoelectric element 512 is in an extended condition. At stage D, the layer 516 is activated so that the layer 516 is extended. Since the layer 518 is not activated, the piezoelectric element 512 bends in a direction that is opposite to the direction in stage B. Accordingly, by applying a voltage to each of the piezoelectric elements 512 in the actuator assembly 510, the piezoelectric elements 512 may operate as fingers or legs that use frictional forces to move the drive rod 508.

Figure 10:
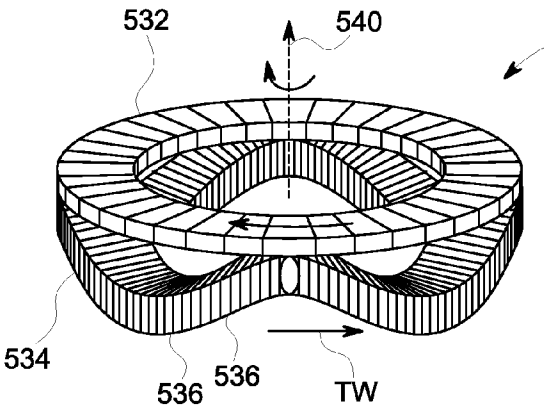
FIG. 10 is an illustrative view of an actuator assembly that may be used in various embodiments.

FIG. 10 illustrates an actuator assembly 530 comprising a rotor 532 and a stator 534. The actuator assembly 530 may be incorporated into rotary-type EM motors, such as the EM motors 450 and 462. In particular embodiments, the actuator assembly 530 is incorporated in ultrasonic motors. The rotor 532 may be operatively coupled to a drive shaft (not shown) that, in turn, is operatively coupled to a mechanical device. As shown, the stator 534 may include a plurality of piezoelectric elements 536 that are arranged in series and interface with the rotor 532. An applied voltage may establish a traveling wave TW along the ring of piezoelectric elements 536 to produce elliptical motion. The activated piezoelectric elements 536 may engage the rotor at different contact points causing the rotor 532 to rotate about an axis 540.

In one embodiment, a method of operating a particle accelerator that has an acceleration chamber is provided. The method may also be used in operating an isotope production system, such as the system 100, or a cyclotron, such as the cyclotron 200. The method includes providing a particle beam of charged particles in the acceleration chamber. The particle beam may be generated as discussed above using, for example, electrical and magnetic fields to direct the charged particles along a desired path.

The method may also include selectively moving a mechanical device within the acceleration chamber to affect the particle beam. The mechanical device may be similar to the mechanical devices 280-282, the stripping assembly 402, the diagnostic probe assembly 440, or the RF device 460. The mechanical device may affect the particle beam by, for example, having the charged particles incident thereon or by affecting the electrical or magnetic fields to control the desired path. By way of a specific example, an RF device may be moved with respect to a hollow dee to affect the resonance frequency. As described above, the mechanical device may be moved by an electromechanical (EM) motor that includes a connector component and piezoelectric elements operatively coupled to the connector component. The connector component is operatively attached to the mechanical device and may be any physical structure capable of being moved and manipulated to control the movement of the mechanical device. When the piezoelectric elements are activated (e.g., by applying a voltage), the EM motor drives the connector component thereby moving the mechanical device.

In particular embodiments, the mechanical devices are located between the pole tops of the magnet yoke that define an inner spatial region or are located adjacent to the poles. For example, at least a portion of a rotatable arm or a shaft member may extend between the pole tops. Furthermore, in particular embodiments, the EM motors may be located between the pole tops or adjacent to the poles. In some embodiments, the mechanical devices are moved with respect to the magnet yoke or, in particular embodiments, the pole tops. The mechanical devices may also be located in hills or valleys of one of the pole tops. For example, the stripping assembly 402 is located along the hill 333 and the probe assembly 440 is located in the valley 337. Furthermore, the EM motors and mechanical devices may be located or spaced apart from an interior wall surface of the magnet yoke, such as the wall surface 322.

In particular embodiments, the particle accelerators and cyclotrons are sized, shaped, and configured for use in hospitals or other similar settings to produce radioisotopes for medical imaging. However, embodiments described herein are not intended to be limited to generating radioisotopes for medical uses. Furthermore, in the illustrated embodiments, the particle accelerators are vertically-oriented isochronous cyclotrons. However, alternative embodiments may include other kinds of cyclotrons or particle accelerators and other orientations (e.g., horizontal).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A particle accelerator comprising:

an electrical field system and a magnetic field system configured to direct charged particles along a desired path within an acceleration chamber, wherein the magnetic field system includes a pair of pole tops that oppose each other across the acceleration chamber;

a mechanical device located within the acceleration chamber and extending between the pole tops, the mechanical device configured to be selectively moved to different positions within the acceleration chamber; and an electromechanical (EM) motor located entirely within the acceleration chamber, wherein the EM motor is mounted to one of the pole tops or adjacent to one of the pole tops and comprises a connector component and piezoelectric elements operatively coupled to the connector component, the connector component being operatively attached to the mechanical device, wherein the EM motor drives the connector component when the piezoelectric elements are activated thereby moving the mechanical device.

2. A particle accelerator comprising:

an electrical field system and a magnetic field system configured to direct charged particles along a desired path within an acceleration chamber;

a mechanical device located within the acceleration chamber, the mechanical device configured to be selectively moved to different positions within the acceleration chamber; and an electromechanical (EM) motor comprising a connector component and piezoelectric elements operatively coupled to the connector component, the connector component being operatively attached to the mechanical device, wherein the EM motor drives the connector component when the piezoelectric elements are activated thereby moving the mechanical device, wherein the entire EM motor consists essentially of non-magnetic material such that the EM motor has at most a negligible effect on an operating magnetic field in the acceleration chamber.

3. The particle accelerator in accordance with claim 1, wherein the mechanical device is configured to be moved into the desired path so that the charged particles are incident thereon.

4. The particle accelerator in accordance with claim 3, wherein the mechanical device comprises a diagnostic probe having a beam detector, the charged particles being incident upon the beam detector.

5. The particle accelerator in accordance with claim 3, wherein the mechanical device comprises a stripping assembly having a stripping foil, the charged particles being incident upon the stripping foil.

6. A particle accelerator comprising:

an electrical field system and a magnetic field system configured to direct charged particles along a desired path within an acceleration chamber;

a mechanical device located within the acceleration chamber, the mechanical device configured to be selectively moved to different positions within the acceleration chamber;

an electromechanical (EM) motor comprising a connector component and piezoelectric elements operatively coupled to the connector component, the connector component being operatively attached to the mechanical device, wherein the EM motor drives the connector component when the piezoelectric elements are activated thereby moving the mechanical device; and wherein the electrical field system includes hollow dees and the mechanical device comprises a capacitor plate, the capacitor plate being configured to move to and from one of the hollow dees.

7. The particle accelerator in accordance with claim 1, wherein the connector component is configured to at least one of move in a linear direction or rotate about an axis.

8. The particle accelerator in accordance with claim 1, wherein the EM motor is one of a piezoelectric motor or an ultrasonic motor.

9. A method of operating a particle accelerator having an acceleration chamber, the method comprising:

providing a particle beam of charged particles in the acceleration chamber, the particle beam being directed along a desired path;

selectively moving a mechanical device within the acceleration chamber, the mechanical device being moved by an electromechanical (EM) motor comprising a connector component and piezoelectric elements operatively coupled to the connector component, the connector component being operatively attached to the mechanical device, wherein the EM motor drives the connector component when the piezoelectric elements are activated;

wherein the mechanical device comprises a capacitor plate that is spaced apart from a hollow dee by a separation distance, said moving operation includes moving the capacitor plate with respect to the hollow dee to change the separation distance and thereby change a resonance frequency of the particle accelerator.

10. The method in accordance with claim 9, wherein said moving operation includes moving the mechanical device so that the charged particles are incident upon the mechanical device.

11. The method in accordance with claim 10, wherein the mechanical device comprises a diagnostic probe having a beam detector, the charged particles being incident upon the beam detector, wherein the method further comprises obtaining measurements of the particle beam using the beam detector at a designated point along the desired path.

12. The method in accordance with claim 10, wherein the mechanical device comprises a stripping assembly having a stripping foil, the charged particles being incident upon the stripping foil.

13. A method of manufacturing a particle accelerator, the particle accelerator including an acceleration chamber and an electrical field system and a magnetic field system that are configured to direct charged particles along a desired path within the acceleration chamber, the method comprising:

positioning a mechanical device within the acceleration chamber and mounting the EM motor to a pole top or adjacent to the pole top, the mechanical device configured to be selectively moved to different positions within the acceleration chamber; and operatively coupling an electromechanical (EM) motor to the mechanical device, the EM motor comprising a connector component and piezoelectric elements that are operatively coupled to the connector component, the connector component being operatively attached to the mechanical device, wherein the EM motor is configured to drive the connector component when the piezoelectric elements are activated thereby moving the mechanical device.

14. The method in accordance with claim 13, wherein said positioning operation includes positioning the mechanical device so that the mechanical device extends between opposing pole tops of a magnet yoke.

15. The particle accelerator of claim 6, wherein the particle accelerator has a resonance frequency that is based on a separation distance between the capacitor plate and said one of the hollow dees, the EM motor configured to selectively move the capacitor plate to and from said one of the hollow dees to change the separation distance and thereby tune the resonance frequency.

16. The particle accelerator of claim 8, further comprising wires that communicatively couple the EM motor to a control system.

17. The method of claim 13, wherein the particle accelerator has a designated magnetic field during operation when the EM motor is not within the acceleration chamber, the method further comprising positioning the EM motor within the acceleration chamber, wherein the magnetic field is not reconfigured after said positioning the EM motor within the acceleration chamber.

* * * * *